United States Patent [19]

Maltby

[11] Patent Number: 4,804,184

[45] Date of Patent: Feb. 14, 1989

[54] METHOD OF FITTING GOLF CLUB TO GOLFER

[75] Inventor: Ralph D. Maltby, Heath, Ohio

[73] Assignee: Ralph Maltby Enterprises, Inc., Newark, Ohio

[21] Appl. No.: 102,061

[22] Filed: Sep. 28, 1987

[51] Int. Cl.[4] ..... A63B 53/00; A63B 53/06

[52] U.S. Cl. ..... 273/77 R; 273/172; 273/79; 273/80.1

[58] Field of Search ..... 273/167 A, 167 H, 174, 273/77 R, 77 A, 167 R, 167 F, 169, 170, 171, 172, 173, 79, 80.1, 164

[56] References Cited

U.S. PATENT DOCUMENTS

| | | | |
|---|---|---|---|
| 1,064,916 | 6/1913 | Kelly et al. | 273/79 |
| 1,913,821 | 6/1933 | Stumpf | 273/174 X |
| 3,190,651 | 6/1965 | Thomas | 273/79 |
| 3,840,231 | 10/1974 | Moore | 237/79 |
| 4,429,879 | 2/1984 | Schmidt | 273/167 H |
| 4,534,564 | 8/1985 | Yamada | 273/167 |
| 4,553,755 | 11/1985 | Yamada | 273/171 |
| 4,618,149 | 10/1986 | Maxel | 273/79 |

*Primary Examiner*—George J. Marlo

*Attorney, Agent, or Firm*—Killworth, Gottman, Hagan & Schaeff

[57] ABSTRACT

A wood golf club head formed of nonwood material comprises a bulbous body defining a face on one side for striking a golf ball. A hosel is integrally formed with and extends from the body for attaching a golf club shaft. A soleplate defines a spherical roll sole toward the toe of the head and a runner toward the heel of the head. The runner extends generally perpendicular to the ball striking face across the body to define a sole line for the head and is ground to adjust the head for fitting a golf club incorporating the head to an individual golfer. The lie of the golf club can be adjusted by uniformly grinding the runner and/or the face angle of the golf club can be adjusted by grinding the runner to slope toward or away from the ball striking face of the head.

3 Claims, 2 Drawing Sheets

METHOD OF FITTING GOLF CLUB TO GOLFER

FIELD OF THE INVENTION

The present invention relates generally to wood golf club heads and, more particularly, to wood golf club heads which are molded of nonwood material and yet can be adjusted for fitting a golf club incorporating the head to an individual golfer.

BACKGROUND OF THE INVENTION

Custom fitting of golf clubs can substantially improve a golfer's performance, and accordingly, is quite popular, particularly when an established golfer is upgrading or replacing a set of golf clubs. A considerable number of variables must be considered when golf clubs are being custom fitted, see "Golf Club Design, Fitting, Alteration and Repair" by Ralph D. Maltby. Loft, lie, and, for wood golf clubs, face angle are among the variables considered.

In a wood golf club, which is defined by the United States Golf Association (USGA) as having a head relatively broad from face to back and usually is made of wood, plastic or a light metal, loft is the angle of the face on its centerline to a line perpendicular to the sole line measured in degrees. Loft is determined at a point one half the distance of the face height. Lie is the angle of the center line of the shaft with the ground line tangent to the sole at the center line of the face. And the angle of the face of a wood golf club to the grounded sole line with the shaft hole perpendicular to the line of flight is the face angle.

The lie and face angle of a wood golf club having a wood head may be determined and adjusted by changing the drill angle on the hosel or neck of the wood head and the turning the neck in alignment with the drilled hole. Loft is normally determined by the shape of the face of the head and its orientation relative to the sole. However, the effective loft of a wood golf club is affected by its face angle, and hence, all three characteristics are to some extent interrelated.

As suggested by the USGA definition, heads for wood golf clubs are now commonly made of molded plastic materials or of cast metals. Unfortunately, when nonwood materials are used to form a wood golf club head, drilling and turning operations to determine the face angle and possibly the lie are impractical. It is also not possible to bend the hosel or neck of the club head because typically such heads are of a hollow construction such that the neck would be weakened and even if the neck could be bent, the club would not "look right" and would not be acceptable to golfers. While it is possible to form a plurality of nonwood golf club heads having varying lies and face angles, the mold costs and inventory problems are prohibitive.

It is thus apparent that the need exists for a wood golf club head which is formed of nonwood material which can have its face angle and/or lie adjusted without changing the angle of the hosel or neck for fitting a golf club incorporating the head to an individual golfer.

SUMMARY OF THE INVENTION

The problems of the prior art associated with wood golf clubs including heads made of nonwood materials are overcome in the present invention by a golf club head including a soleplate with at least one runner which is ground to adjust the head to custom fit a golf club including the head to an individual golfer, and a method of making such a custom fitted golf club head.

In accordance with one aspect of the present invention, a wood golf club head formed of nonwood material comprises a bulbous body defining a face on one side thereof for striking a golf ball. A hosel or neck is integrally formed with and extends from the body for attaching a golf club shaft. A soleplate, integrally formed on the underside of the body, defines at least one runner extending generally perpendicular to the ball striking face and across the body to define a sole line for the head. The at least one runner is ground to adjust the head for fitting a golf club incorporating the head to an individual golfer. The at least one runner can be ground to slope toward or away from the ball striking face of the head to adjust the face angle of the golf club incorporating the head.

Preferably, the soleplate comprises a spherical section or roll face toward the toe of the head and a single runner toward the heel of the head, with the single runner being spaced from the spherical section. In accordance with this embodiment of the present invention, the entire runner can be ground uniformly to adjust the lie of a golf club incorporating the head or the lie and/or face angle can be adjusted by grinding the entire runner to define a slope toward or away from the ball striking face. The runner must be of sufficient thickness to permit grinding operations to be performed to define a reasonable range of adjustments to accommodate fitting a golf club incorporating the head to an individual golfer.

In accordance with another aspect of the present invention, a method of making a wood golf club head from nonwood material comprises forming a bulbous body for the head defining a face for striking a golf ball, a hosel for receiving a shaft and a soleplate including at least one runner extending generally perpendicular to the face and across the body to define a sole line for the head. The at least one runner is then ground to adjust the head for fitting a golf club incorporating the head to an individual golfer. The grinding step is performed to make the at least one runner slope toward or away from the ball striking face to adjust the face angle of the golf club incorporating the head.

Preferably, the soleplate comprises a spherical section or roll face toward the toe of the head and a single runner toward the heel of the head, with the single runner being spaced from the spherical section. In this preferred embodiment of the soleplate, the grinding operation can be performed uniformly on the entire runner to adjust the lie of the golf club incorporating the head, can be performed to make the single runner slope toward or away from the face to adjust the face angle of the club incorporating the head, or can be performed to adjust both the lie and the face angle of the club incorporating the head.

It is an object of the present invention to provide a wood golf club head molded of nonwood material which defines an integrally formed soleplate on the underside of its bulbous body, which soleplate defines at least one runner which is ground to adjust the head for fitting a golf club incorporating the head to an individual golfer.

It is another object of the present invention to provide a method of making a wood golf club head by molding the head from a nonwood material with an integral soleplate having at least one runner and grinding that runner to adjust the head for fitting a golf club incorporating the head to an individual golfer.

Other objects and advantages of the present invention will be apparent from the following description, the accompanying drawings and the appended claims.

DETAILED DESCRIPTION OF THE INVENTION

Figure 1:
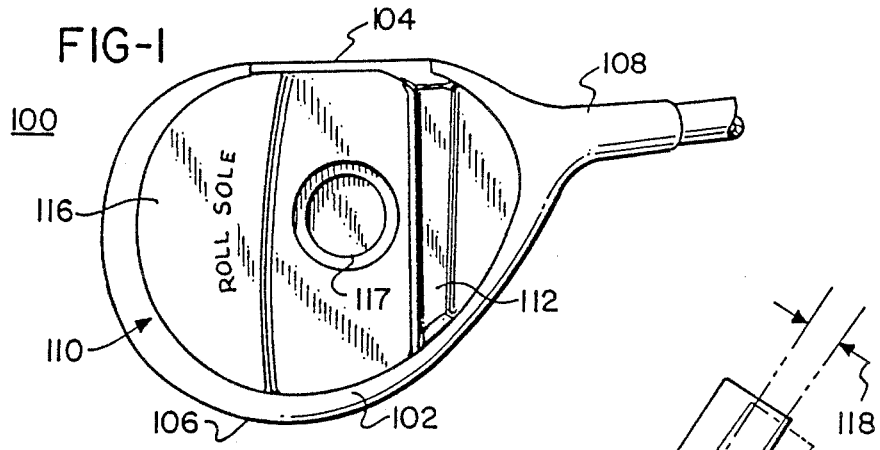
FIGS. 1, 2 and 3 show a bottom, side and rear view of an adjustable head for a custom fit golf club in accordance with the present invention.

An adjustable head 100 in accordance with the present invention for a custom fit wood golf club is shown in the drawing figures. The head 100 has a bulbous body 102 which is relatively broad from a ball striking face 104 to the back 106 and is made of a nonwood material, such as plastic, or preferably, a light metal. A hosel 108 is integrally formed with and extends from the bulbous body 102 for attaching a shaft to the club head 100. A soleplate 110 is integrally formed on the underside of the body 102 and defines at least one runner extending generally perpendicular to the face 104 and defining a sole line 111 for the golf club head 100.

In the illustrated embodiment, the soleplate 110 comprises a spherical section 116 which forms a roll plate or roll sole toward the toe of the golf club head 100 and a single runner 112 toward the heel, with the single runner 112 being spaced from the spherical section 116. The space between the runner 112 and the spherical section 116 conveniently receives a weight port 117. The runner 112 must be of a sufficient vertical thickness (see FIG. 2) to be ground to adjust the head 100 for fitting a golf club incorporating the head 100 to an individual golfer.

Figure 2:
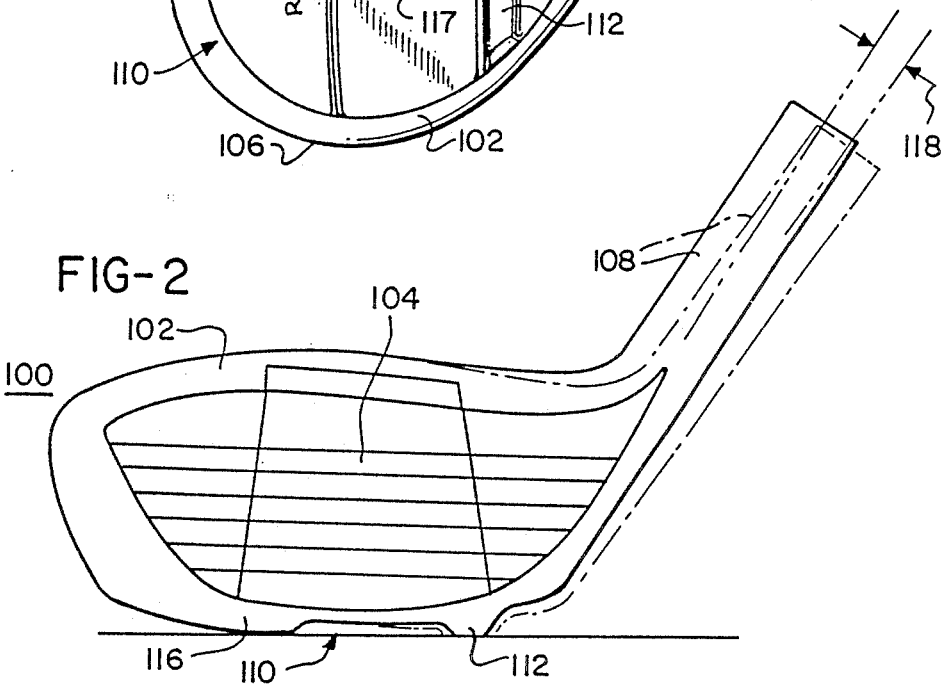
Figure 3:
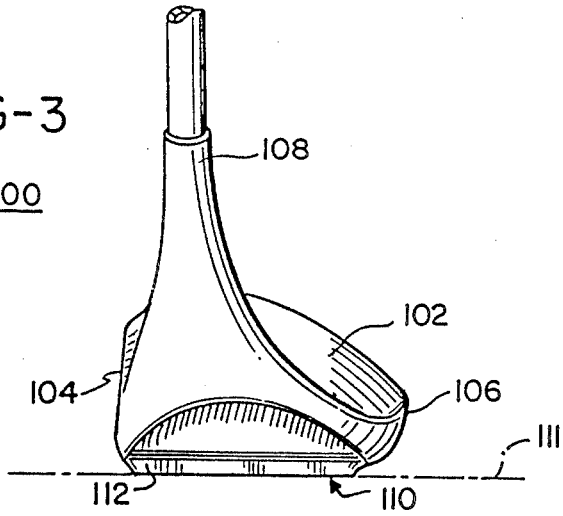

As shown in FIG. 2, a portion of the entire length of the runner 112 can be ground uniformly to adjust only the lie angle of a golf club incorporating the head 100 up to several degrees more flat. The solid line drawing of the golf club head 100 shows the hosel 108 before the runner 112 is ground, and the dashed line drawing shows the hosel 108 after grinding, the angle 118 indicating the change in the lie. Alternately, the face angle of a club incorporating the head 100 can be adjusted by grinding the runner 112 to slope toward the face 104 to close the face angle, or to slope away from the face 104 to open the face angle. Of course, it should be apparent that the runner 112 can be ground to adjust both the lie and the face angle of a club incorporating the head 100 of the present invention. The adjustment of the face angle of a club is more clearly shown and will now be described with reference to FIGS. 4 and 5.

Figure 4:
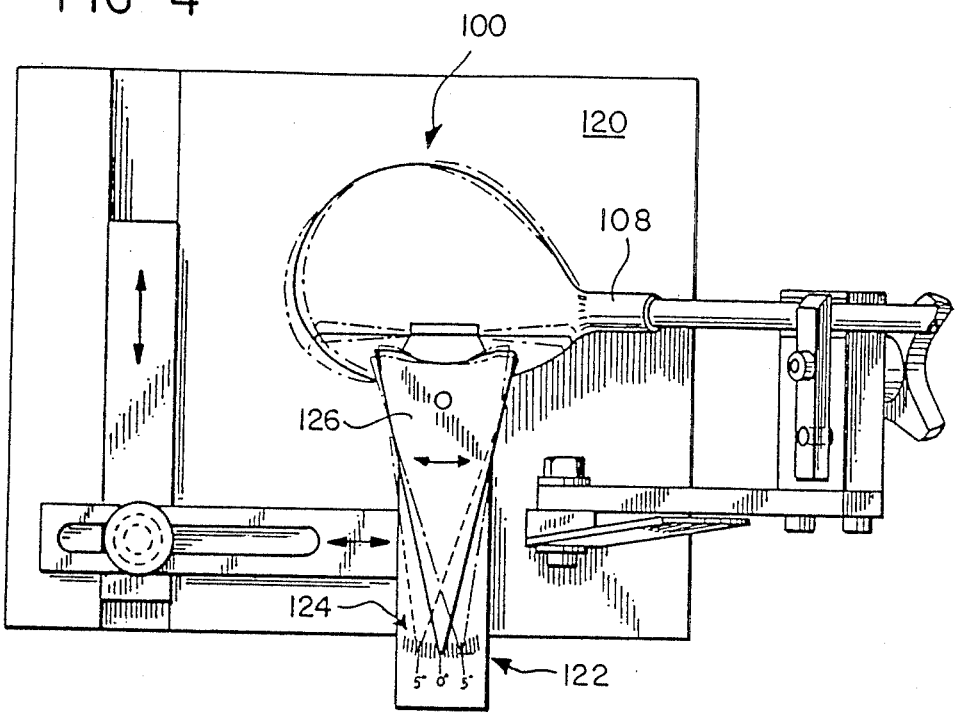
FIG. 4 illustrates the adjustability of the face angle of a golf club head in accordance with the present invention measured by means of a commercially available golf club gauge.

In FIG. 4, a golf club including the golf club head 100 in accordance with the present invention is shown secured into a golf club gauge which is used to measure face angle among other variables of a golf club. While further description of the golf club gauge is not required for an understanding of the present invention, a thorough description of the utilization of this gauge is described in "Golf Club Design, Fitting, Alteration and Repair," by Ralph D. Maltby. As shown in the solid line drawing, the club head 100 is preferably formed to have an initial zero degree face angle or to have a square face. Face angle is indicated by the golf club gauge 120 by means of a face angle gauge 122. The face angle gauge 122 includes a scale 124 and a pivotally mounted pointer 126 which contacts the face 104 of a golf club head at two points to measure the face angle. The solid line drawing of the pointer 126 shows a zero degree face angle or square face initially on the golf club incorporating the golf club head 100 prior to any grinding of the runner 112. Of course, any reasonable preliminary face angle can be selected the club head 100 with adjustments then being made to close or open the preliminary face angle for club fitting purposes.

Figure 5:
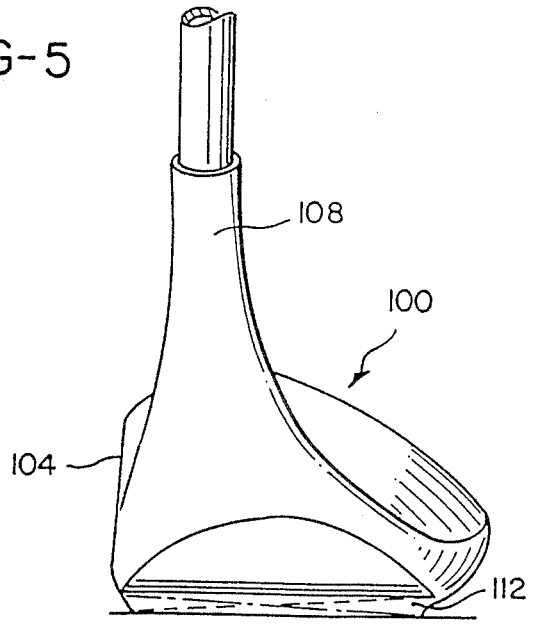
FIG. 5 illustrates the adjustability and the method of making an adjustable golf club head in accordance with the present invention.

In FIG. 5, the rear of the golf club incorporating the golf club head 100 of FIG. 4 is shown separate from the golf club gauge 120 for ease of illustration. As shown by the dashed line extending across the runner 112, the runner 112 can be ground to slope toward the face 104 which will close the face angle of the golf club incorporating the golf club head 100. This is illustrated by the dashed line drawings in FIG. 4 where the angle of the golf club has been adjusted to a 5° closed or hook face angle. Alternately, the runner 112 may be ground to slope away from the face 104 to open the face angle of the golf club including the golf club head 100 as shown by the dotted line extending across the runner 112 in FIG. 5. This is illustrated in FIG. 4 by the dotted line drawings where the face angle of the golf club has been adjusted to a 5° open or slice face angle.

It should be apparent that a wood golf club head formed of nonwood material and the method of making that head to adjust its face angle and/or lie without changing the angle of the hosel for fitting a golf club incorporating the head to an individual golfer has been disclosed. It should also be apparent that the soleplate 110 could be modified to define one or more additional runners which could be ground the same as, or to complement the runner 112 for adjustment of the head 100. Further, a variety of widths are possible for the runner 112, or any one or more additional runners which may be formed on the soleplate 110. Such modifications and alternate embodiments are considered to be within the scope of the present invention.

Accordingly, while the method herein described and the form of apparatus for carrying this method into effect constitute preferred embodiments of this invention, it is to be understood that the invention is not limited to this precise method and form of apparatus, and that changes may be made in either without departing from the scope of the invention which is defined in the appended claims.

What is claimed is:

1. A method of fitting a golf club to a golfer comprising:

making a wood type golf head entirely from nonwood material, said head including a bulbous body defining a face for striking a golf ball, a hosel for receiving a shaft, and a sole, providing said sole with at least one runner extending generally perpendicular to said face across said body and defining a sole line for said head, and removing material from said at least one runner to adjust the face angle, lie and/or loft of said head to fit a golf club incorporating said head to an individual golfer.

2. A method of fitting a golf club to a golfer as claimed in claim 1 wherein said step of removing material is performed to make said at least one runner slope toward or away from said face.

3. A method of fitting a golf club to a golfer as claimed in claim 1 wherein said sole comprises a spherical section toward the toe of said head and a single runner toward the heel of said head, said single runner being spaced from said spherical section.

* * * * *